US007252179B2

(12) United States Patent
Oberleitner

(10) Patent No.: US 7,252,179 B2
(45) Date of Patent: Aug. 7, 2007

(54) ELEVATOR-DOOR LATCHING AND OPENING DEVICE

(75) Inventor: Rupert Oberleitner, Petzenkirchen (AT)

(73) Assignee: Wittur AG, Wiedenzhausen (DE)

( * ) Notice: Subject to any disclaimer, the term of this patent is extended or adjusted under 35 U.S.C. 154(b) by 0 days.

(21) Appl. No.: 10/512,396

(22) PCT Filed: Apr. 17, 2003

(86) PCT No.: PCT/EP03/50116

§ 371 (c)(1),
(2), (4) Date: Nov. 29, 2005

(87) PCT Pub. No.: WO03/089356

PCT Pub. Date: Oct. 30, 2003

(65) Prior Publication Data

US 2006/0174540 A1 Aug. 10, 2006

(30) Foreign Application Priority Data

Apr. 22, 2002 (AT) ..... A 619/2002

(51) Int. Cl.
*B66B 13/06* (2006.01)

(52) U.S. Cl. ..... 187/335; 187/315; 187/319; 187/330; 49/118

(58) Field of Classification Search ..... 187/314, 187/319, 330, 335; 49/118; *B66B 13/06*
See application file for complete search history.

(56) References Cited

U.S. PATENT DOCUMENTS

| | | | | |
|---|---|---|---|---|
| 3,605,952 | A * | 9/1971 | Lusti | 187/319 |
| 4,947,964 | A * | 8/1990 | Husmann | 187/319 |
| 5,246,089 | A * | 9/1993 | Husmann et al. | 187/319 |
| 5,377,785 | A * | 1/1995 | Pearson | 187/308 |
| 6,173,815 | B1 | 1/2001 | Mittermayr | |

FOREIGN PATENT DOCUMENTS

| | | |
|---|---|---|
| EP | 0 164 581 | 12/1985 |
| EP | 0 332 841 | 9/1989 |
| EP | 0 426 057 | 5/1991 |
| EP | 0 634 353 | 1/1995 |
| EP | 0 709 334 | 5/1996 |
| EP | 0 744 373 | 11/1996 |

* cited by examiner

*Primary Examiner*—Gene O. Crawford
*Assistant Examiner*—Stefan Kruer
(74) *Attorney, Agent, or Firm*—Andrew Wilford

(57) ABSTRACT

Elevator doors have operating bars that are pivoted on a car door and that serve to actuate shaft-door actuating rollers that operate shaft doors. These doors are operated by an apparatus having an actuating device that changes a spacing between the operating bars and that has an actuating lever coupled with a door actuator. This actuating lever is coupled with a first link pivoted on the operating bars. The actuating lever and the first link are pivotal through a predetermined angle. A latch for the car doors is provided with a tension element connected between one operating bar and the actuating lever.

12 Claims, 4 Drawing Sheets

ELEVATOR-DOOR LATCHING AND OPENING DEVICE

BACKGROUND OF THE INVENTION

Field of the Invention

The invention relates to an apparatus for operating and latching elevator doors with operating bars that are pivoted on a car door and that are provided to actuate shaft-door actuating rollers that operate shaft doors, an actuating device being provided that changes a spacing between the operating bars and that has an actuating lever coupled with a door actuator, the actuating lever being coupled with a first link pivoted on the operating bars, and wherein a latch device is provided to latch the car doors.

Elevator doors are normally operated such that a door actuator is provided on the elevator car that effects opening and closing of the car doors. The shaft doors that are provided at each landing for the elevator, normally do not have the own door actuators, but are operated via an entrainment device by the car doors. The entrainment device normally also serves to latch the shaft doors.

Normally shaft-door actuating rollers are provided on the shaft doors that are horizontally spaced from each other. The entrainment device that is mounted on the door of the elevator car, has operating bars that extend vertically and whose relative spacing is variable. Unlatching of the shaft doors is triggered by action of the operating bars on the shaft-door actuating rollers. This force can push the rollers together or apart. In practice such systems are called closing or spreading couplers.

As soon as the shaft doors are unlatched, the car doors can start to open, the car doors pushing open the shaft doors by action of the operating bars on the shaft-door actuating rollers so that the car doors and the shaft doors open simultaneously. Closing takes place in reverse.

The car doors themselves are often not completely latched, that is they are held in the closed position only by the force of the door actuator. Under certain circumstances it is however necessary or required by statute to provide for latching of the car doors so as to prevent opening of the car doors outside the so-called stopping stations, that is the landings where the elevator car is supposed to stop. On the other hand it is however necessary when in the stopping station to unlatch the doors, whether during normal intentional opening of the car doors or in an emergency during a power outage when the car has been manually dropped, EP 0.426,057, EP 0,709,334, and EP 0.164,581 describe latch devices where the latching is effected by a lever that engages a feeler roller and the feeler roller is pushed out of its rest position in the stopping stations by fixed cams. In the rest position the car doors are latched. A disadvantage of these solutions is the difficulty of adjusting a number of cams.

EP 0,744,373 proposes a solution whereby actuation of the latch of the shaft door is transmitted to the latch for the car doors. The necessary mechanism has a great many parts.

In order to avoid these disadvantages, solutions have been developed that couple the latch device for the car door with the movement of the operating bars so that so additional cams need be provided at the landings. Such solutions are seen for example in U.S. Pat. No. 6,173,815 and EP 0,332, 841 (equivalent U.S. Pat. No. 4,947,964). The apparatuses are constructed such that the car doors are always latched when the door drive pushes the doors into the closed positions. The latching thus is active when the door drive for example fails because of a power outage when not at a landing and is activated unintentionally by accident and thus the operating bars are put in a position that corresponds to unlatching of the shaft doors. Only when at a stopping station at a landing is it possible to unlatch the car doors since the operating bars are activated, that is bear on the shaft-door actuating rollers and cannot carry out their theoretical full possible movement. With the known solutions these functions are effected by a number of levers that are connected between the door actuator and one of the operating bars. The known solutions are mechanically complex and hence expensive to manufacture and maintain. Examples are seen in EP 0.634,353 and similar EP 0,332, 841. One operating bar is provided with a sensor element (rocker 3 in EP 0.634,353 or element 4 in EP 0,332,841). This sensor element is biased such that it maintains a spacing from the operating bar. When at a landing the operating bar is pressed against the shaft-door actuating roller, the sensor element is pressed against the operating bar and this movement is used to unlatch the car door. In EP 0,634,353 the movement is transmitted by a cable while in EP 0,332,841 a cam is used that bears against a control roller 14.

OBJECT OF THE INVENTION

It is an object of the invention to improved on the above-described solutions so that on one hand fixed cams for actuating the car-door latches can be dispensed with and on the other hand a mechanically simple and cheap-to-manufacture actuating apparatus is provided.

SUMMARY OF THE INVENTION

According to the invention this is achieved in that the actuating lever and the first link are pivotal through a predetermined angle and that the latch device is provided with a tension element connected between one operating bar and the actuating lever. If here the operating bar presses against the shaft-door actuating rollers, there is a relative movement of the actuating lever and the first link. This is transmitted by the tension element, that is connected to the operating bar and to the actuating lever, and applied to the latch device. According to the invention thus with a limited number of moving parts the object is achieved, so that a simple construction and cheap manufacture is possible. The present invention works equally well for closing and spreading couplers and is easily adapted to the different typed of latch devices. The tension element can be a cable, and can also be a belt, formed of steel and an appropriate plastic or the like.

In a particularly advantages embodiment of the invention the tension element has one end secured to one of the operating bars and passes around a deflecting wheel on the actuating lever. In this manner the construction is particularly simple.

An advantageous embodiment with regard to manufacture of the apparatus is seen when there is a second link that forms with the first link and with the operating bars a parallelogrammatic linkage.

BRIEF DESCRIPTION OF THE DRAWINGS

In the following the invention is more closely described with reference to the embodiment shown in the figures.

SPECIFIC DESCRIPTION

Figure 1:
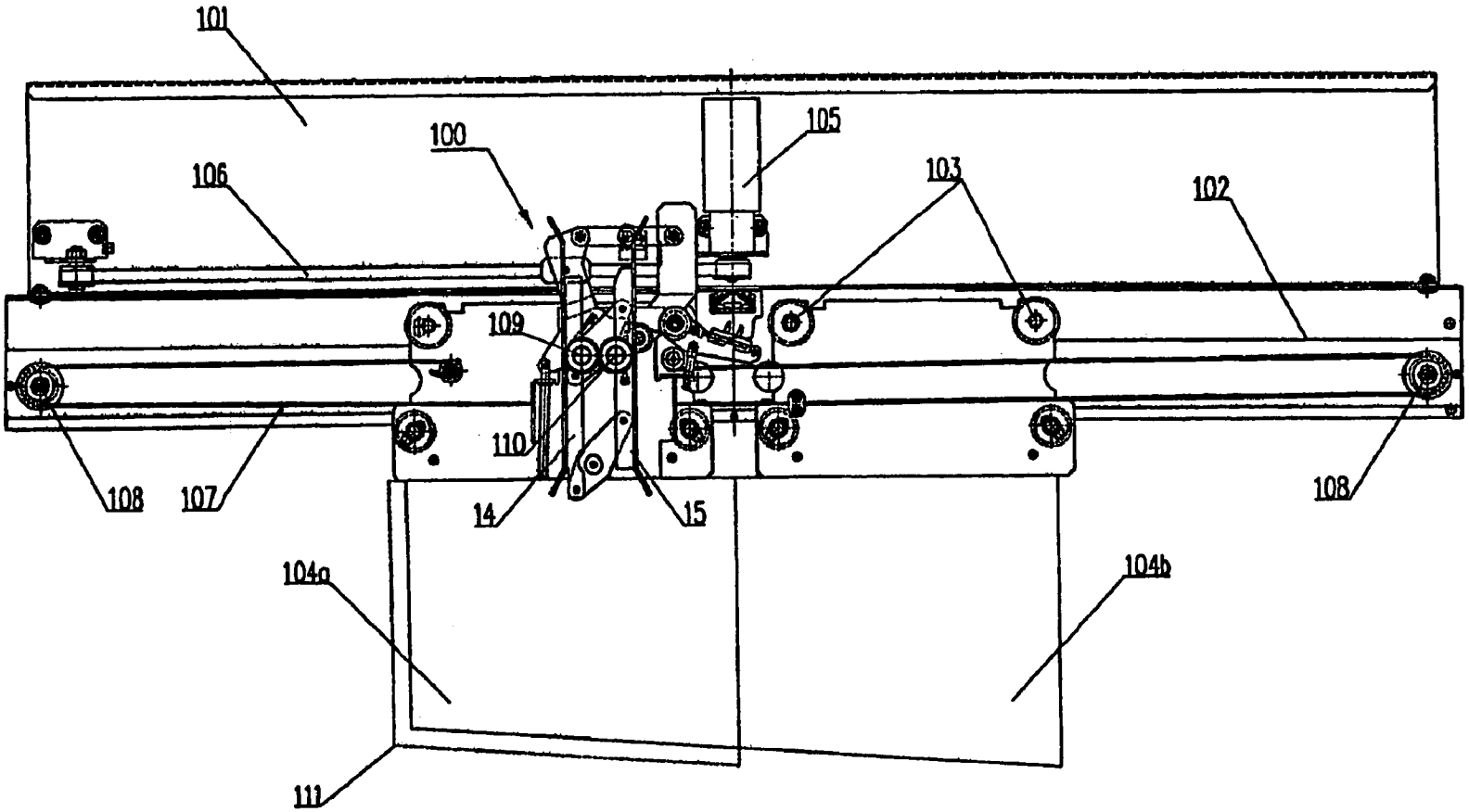
FIG. 1 shows an overall view of an apparatus according to the invention when installed.

FIG. 1 shows an apparatus 100 according to the invention installed. A door support 101 in the form of a beam is provided above the entry opening of an unillustrated elevator car. The door support 101 carries guide rails 102 on which ride rollers 103 from which car doors 104*a* and 104*b* are hung. The car doors 104*a* and 104*b* are operated by an electric motor 105 that is mounted on the door support 101 and that drives a belt 106. The drive belt 106 is connected with an actuating lever 1 of the apparatus 100. Since the apparatus 100 is directly connected with the first car door 104*a*, the first car door 104*a* is entrained by the drive belt 106. The first car door 104*a* is also connected with an endless cable 107 that lies in a vertical plane and is spanned over deflecting wheels 108. The second car door 104*b* is also connected with the endless belt 107 such that the opening and closing movements of the car doors 104*a* and 104*b* are simultaneous and opposite. In addition FIG. 1 shows shaft-door actuating rollers 109 and 110 of shaft doors 111 shown in dashed lines between operating bars 14 and 15.

Figure 2:
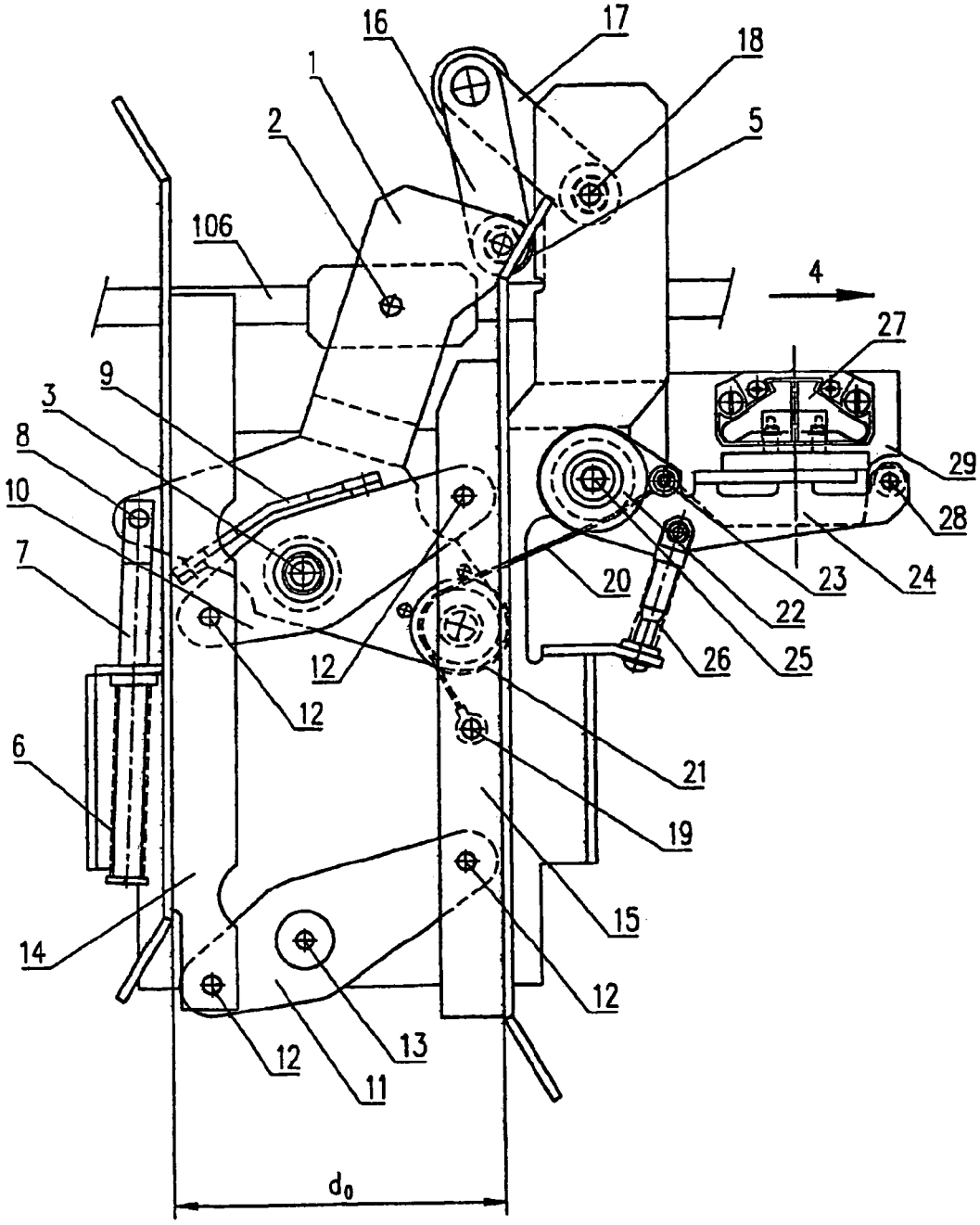
FIG. 2 shows the apparatus of FIG. 1 in larger scale in a position in which the door actuator has closed the car door.
Figure 4:
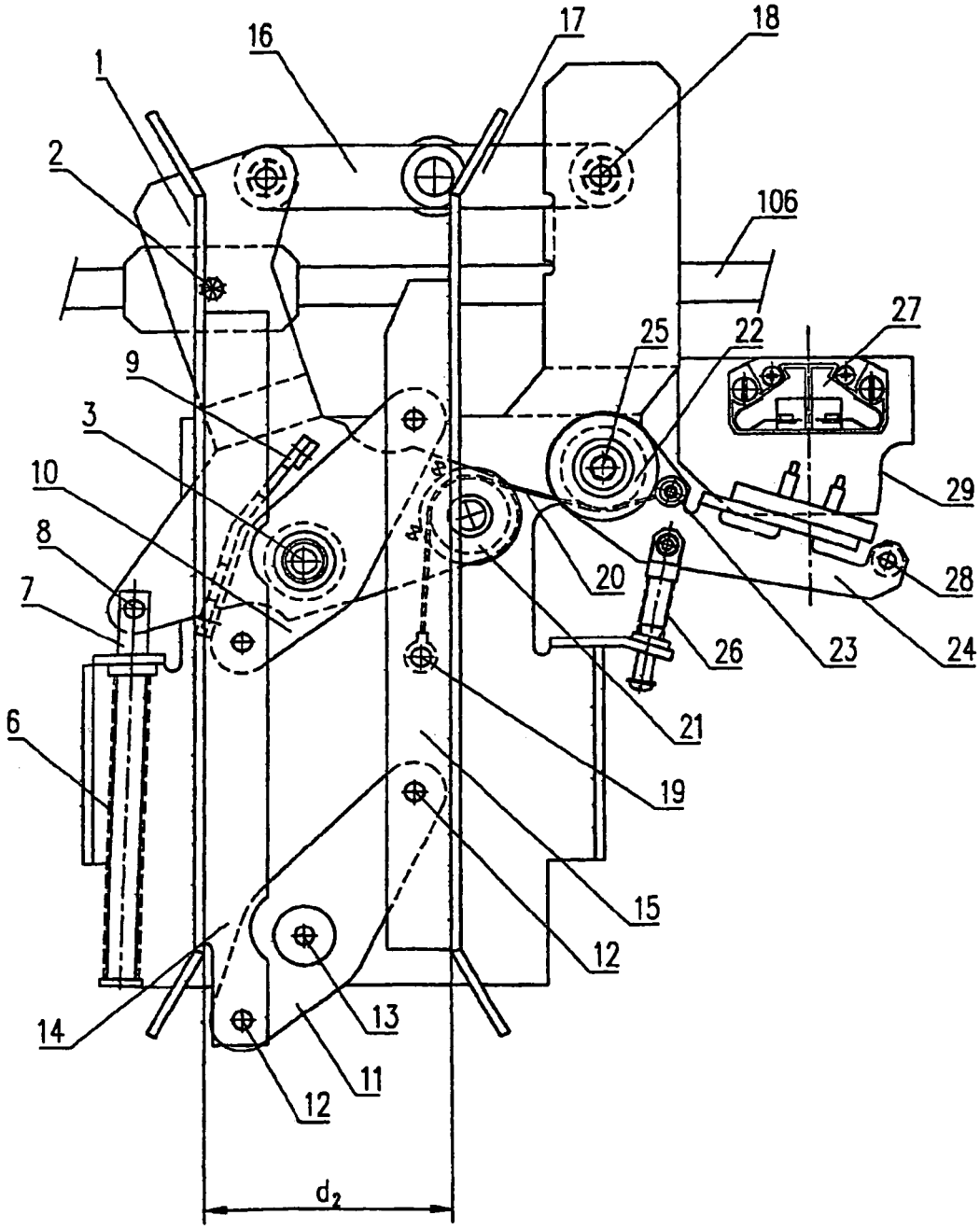
FIG. 4 shows a position in which the latch is unlatched at the landing in order to open the car door.

Now the door operator will be described briefly. FIG. 2 shows a situation where the car doors 104*a* and 104*b* and the shaft doors 111 are closed. The operating bars 14 and 15 of the apparatus 100 are out of engagement with the shaft-door actuating rollers 109 and 110 so that the car can move without affecting these door-actuating rollers 109 and 110. Opening of the doors 104 and 104*b* is initiated by actuation of the electric motor 105 to move the drive belt 106. Movement of the drive belt 106 first operates the actuating lever 1 in the apparatus 100 that in turn moves the operating bars 14 and 15 toward each other. The operating bars push against the shaft-door actuating rollers 109 and 110 to release an unillustrated latch for the shaft doors 111. This position is shown in FIGS. 1 and 4. As soon as the actuating lever 1 of the apparatus 100 engages an abutment 5, the entire apparatus 100 is pulled by the drive belt 106 to the left in FIG. 1 and starts opening the first car door 104*a*. Simultaneously the cable 107 moves the second car door 104*b* in the opposite direction. The shaft-door drive rollers 109 and 110 entrain and also open the shaft doors 111.

The actuating lever 1 for the apparatus 100 according to the invention is connected at a pivot 2 with the drive belt 106. The actuating lever 1 can turn about a pivot 3 fixed on the car door 104*a*. In the FIG. 2 position the drive belt 106 pivots the actuating lever 1 in the direction of an arrow 4 so that an end of the actuating lever 1 engages the abutment 5 fixed on the car door 104*a*. Tension in the drive belt 106 holds the car door 104*a* in its closed position. A coil spring 6 pulls via a tension rod 7 pivoted at 8 on the actuating lever 1 to pivot it in a counterclockwise direction. The actuating lever 1 carries a bar 9 that couples the actuating lever 1 with a small amount of lost motion with a first link 10. The first linke 10 forms with a similar second link 11 and the two operating bars 14 and 15 a parallelogrammatic linkage having pivots 12. The first link 10 is centrally mounted at the same pivot 3 as the actuating lever 1. The second link 11 turns about a pivot 13 below the pivot 3.

In the FIG. 2 position it is clear that the two operating bars 14 and 15 have a maximal spacing $d_0$ so that the here unillustrated shaft-door actuating rollers 109 and 110 are not touched. The actuating lever 1 is connected by first and second travel-limiting links 16 and 17 with a fixed pivot 18, which links 16 and 17 are in the illustrated position folded together.

The second operating bar 15 has an anchor point 19 for an end of a pull cable 20 that passes over a deflecting wheel 21 carried on the actuating lever 1. The other end of the pull cable 20 is secured at an anchor point 23 on a latch element 24 that turns about a pivot 25. Near the anchor point 23 the pull cable 20 passes around another deflecting wheel 22 mounted on the latch element 24. A compression spring 26 biases the latch element 24 counterclockwise. The latch element 24 has on its end opposite the pivot 25 a latch pin 28 that in the positions of FIGS. 2 and 3 engages in a stationary latch seat 29 and thus mechanically latches the car door 104*a*.

The latch element 24 also operates a switch 27 that serves to monitor the latched condition of the car doors 104*a* and 104*b*. In this manner it is possible to satisfy safety regulations that require that the car be stopped immediately if the car doors 104*a* and 104*b* are unlatched.

Figure 3:
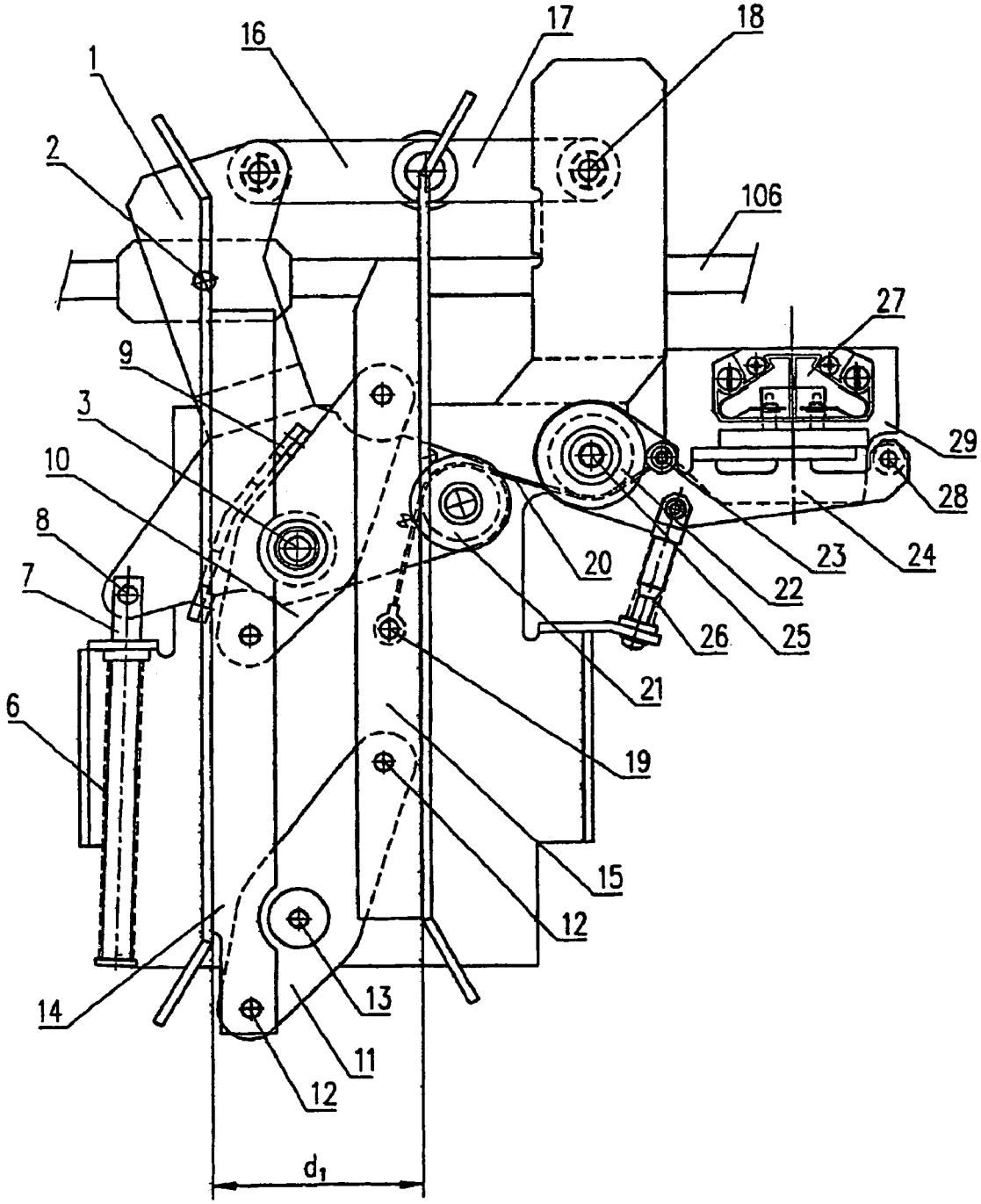
FIG. 3, like FIG. 2, shows a position of the apparatus when the door actuator has failed with the car door latched.

FIG. 3 shows a situation in which the door actuator has failed or has mistakenly tried to open the car doors 104*a* and 104*b* outside the designated stopping location. The actuating lever 1 is here set at its end position pivoted counterclockwise, in which position the links 16 and 17 are spread. When the door actuator has failed this position is set by the force of the spring 6 which urges the actuating lever 1 into the illustrated position. The links 10 and 11 are also maximally pivoted counterclockwise and move the operating bars 14 and 15 as close as possible together to a spacing $d_1$. As a result of the geometric relationships between the actuating lever 11, the wheels 21 and 22, and the attachment at point 19, no significant tension is applied to the pull cable 20 as a result of movement from the FIG. 2 to the FIG. 3 position so that the latch element 24 stays in the latched position. This ensures that even if power fails or there is an unauthorized attempt to open the car doors 104*a* and 104*b*, they will remain latched.

The position of the apparatus shown in FIG. 4 corresponds to an intentional opening of the car doors 104*a* and 104*b*. The actuating lever 1 is thus pivoted counterclockwise to its end position by the drive belt as in FIG. 3. Unlike FIG. 3, however, inward movement of the operating bars 14 and 15 is limited by the shaft-door actuating rollers 109 and 110 so that the operating bars 14 and 15 are set at a spacing $d_2$ corresponding to:

$$d_1<d_2<d_0.$$

The coupling bar 9 thus pushes against the first link 10, taking up the play between the coupling bar 9 and the link 10. Since in the FIG. 4 position inward movement of the operating bars 14 and 15 is limited, the distance between the anchor point 19 and the first deflecting wheel 21 is increased so that the cable 20 is tensioned and moves the latch element 24 clockwise. This movement pulls the latch pin 28 out of the latch seat 29 and frees the car door 104*a*. In addition the switch 27 is opened and stops sending the latched signal.

It is to be noted that the position of FIG. 4 can be reached during normal operation by actuation of the door drive from the position of FIG. 2 in the stopping station and also in an emergency from the position of FIG. 3 when, for example, the car drops mechanically on power failure into the stopping station. In the latter case the operating bars 14 and 15 are pushed apart by the shaft-door actuating rollers 109 and 110 which unlatches the car doors 104*a* and 104*b* in order to free a person trapped in the car.

The instant invention makes it possible with a minimum number of parts to provide a safe car door latch for elevators complying with standard safety rules.

The invention claimed is:

1. An apparatus for operating and latching elevator doors with operating bars that are pivoted on a car door and that are provided to actuate shaft-door actuating rollers that operate shaft doors, the apparatus comprising:

an actuating device that changes a spacing between the operating bars and that has an actuating lever coupled with a door actuator, the actuating lever being coupled with a first link pivoted on the operating bars, and a latch device that latches the car doors, the actuating lever and the first link being pivotal through a predetermined angle, the latch device being provided with a tension element connected between one operating bar and the actuating lever, the tension element having one end fixed to the one operating bar, and passing around a deflecting wheel mounted on the actuating lever.

2. The apparatus according to claim 1 wherein the latch device has a latch that is connected with an end of the tension element and that operates a switch monitoring the latching.

3. The apparatus according to claim 1 wherein the tension element is a cable.

4. The apparatus according to claim 1 wherein the tension element is a belt.

5. The apparatus according to claim 1 comprising a second link, said second link forming a parallelogrammatic linkage with the first link and with the operating bars.

6. The apparatus according to claim 1 wherein the latch device has a latch that is connected with an end of the tension element and that operates a switch monitoring a latching.

7. The apparatus according to claim 1 wherein the latch device has a latch and a compression spring biasing the latch into a closed position.

8. An apparatus for operating and latching elevator doors with operating bars that are pivoted on a car door and that are provided to actuate shaft-door actuating rollers that operate shaft doors, the apparatus comprising:

an actuating device that changes a spacing between the operating bars and that has an actuating lever coupled with a door actuator, the actuating lever being coupled with a first link pivoted on the operating bars, and a latch device that latches the car doors, the actuating lever and the first link being pivotal through a predetermined angle, the latch device being provided with a tension element connected between one operating bar and the actuating lever, the latch device having a latch that is biased by a compression spring into a closed position.

9. The apparatus according to claim 8 wherein the tension element has one end fixed to the one operating bar and passes around a deflecting wheel mounted on the actuating lever.

10. The apparatus according to claim 8 wherein the tension element is a cable.

11. The apparatus according to claim 8 wherein the tension element is a belt.

12. The apparatus according to claim 8, comprising a second link, said second link forming a parallelogrammatic linkage with the first link and with the operating bars.

* * * * *